United States Patent [19]

Asakura

[11] Patent Number: 4,898,114

[45] Date of Patent: Feb. 6, 1990

[54] FIN PAD OF SMALL MARINE CRAFT

[75] Inventor: Yukio Asakura, Hyogo, Japan

[73] Assignee: Kawasaki Jukogyo Kabushiki Kaisha dba Kawasaki Heavy Industries, Ltd., Kobe, Japan

[21] Appl. No.: 314,455

[22] Filed: Feb. 23, 1989

[30] Foreign Application Priority Data

Feb. 23, 1988 [JP] Japan ..... 63-23689[U]

[51] Int. Cl.[4] ..... B63B 29/00

[52] U.S. Cl. ..... 114/343; 114/270

[58] Field of Search ..... 114/270, 343, 364, 363, 114/85; 440/38; 297/218, 219, 463

[56] References Cited

U.S. PATENT DOCUMENTS

| | | | |
|---|---|---|---|
| 4,030,436 | 6/1977 | Stoberl | 114/363 |
| 4,442,787 | 4/1984 | Curran et al. | 114/363 |
| 4,703,710 | 11/1987 | Kawahara | 114/363 |

*Primary Examiner*—Joseph F. Peters, Jr.
*Assistant Examiner*—Edwin L. Swinehart
*Attorney, Agent, or Firm*—Poms, Smith, Lande & Rose

[57] ABSTRACT

A fin pad is disclosed for covering one or both of the fins provided on either side of the deck floor of a small water craft. The pad includes a cushion having an inner lower edge which curves toward and overlies portions of a floor mat covering the deck floor between the fins. A back sheet associated with the cushion is adapted to be fixed to the adjacent one of the fins and is anchored to the deck floor by an anchor associated with an inner edge of the back sheet and the deck floor.

1 Claim, 4 Drawing Sheets

FIN PAD OF SMALL MARINE CRAFT

FIELD AND BACKGROUND OF THE INVENTION

The present invention relates to an improvement in a fin pad for a small marine craft or watercraft.

A conventional fin pad is shown in FIG. 8 of the accompanying drawings, wherein a fin 11 stands on each end (right end in FIG. 8) of a deck floor 10. The interior of fin 11 is filled with foam urethane 12 as buoyant material. Floor mat 13 and cushion material 14 are adhered to the surfaces of floor 10 and fin 11, respectively. The cushion 14 feels soft when touched by the rider's leg on the floor 10. Between the mat 13 and cushion 14 is formed a clearance C, where dust will collect unfavorably.

The assignee of this application has then developed a prior art fin pad as shown in FIG. 9. The pad includes back base material 15 covered by cushion material 17 adhered thereto, and is fixed to a fin 11 with tapping screws 16 and caps 18. The lower end of cushion 17 overlaps with the adjacent edge of a floor mat 13. When the rider steps on the edge of mat 13, however, it is compressed forming a clearance between it and the cushion 14, where dust will collect similarly.

SUMMARY OF THE INVENTION

The object of this invention is to provide a fin pad for a small watercraft, which can prevent clearance from being formed between a floor mat and a fin pad.

According to this invention, a fin pad is provided for covering one of fins standing on both sides of a deck floor of a small watercraft, said floor being covered by a mat between said fins. The fin pad comprises a cushion having an inner lower edge, which curves toward said mat and overlies on the adjacent edge of said mat, a back sheet covered by said cushion and adapted to be fixed to said one of fins, and anchor means provided on the inner lower edge of said back sheet to engage a part of said floor.

BRIEF EXPLANATION OF THE DRAWINGS

Preferred embodiments of this invention are shown in the accompanying drawings, wherein.

DETAILED DESCRIPTION OF THE INVENTION

Figure 1:
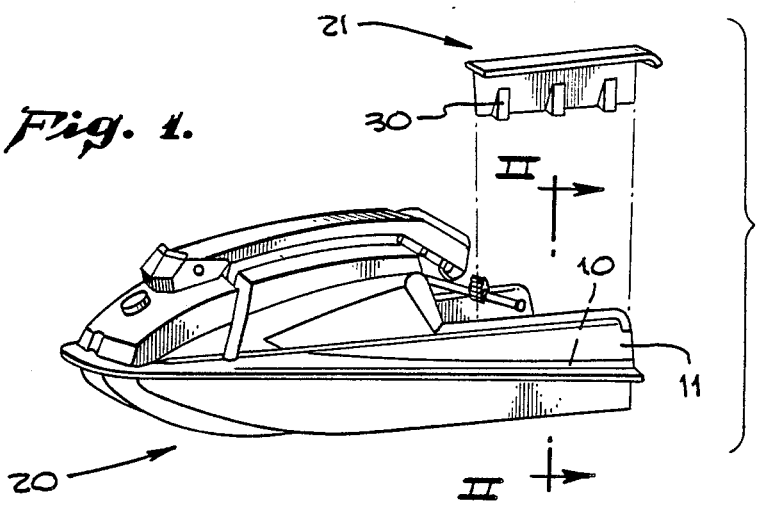
FIG. 1 is a simplified, exploded perspective view of a small marine craft to which a fin pad according to one embodiment of the invention is applied.

In FIG. 1, a hull 20 includes a floor 10 for the rider adjacent the aft end. From the right and left ends of floor 10 upwardly extend a pair of fins 11 like walls. A fin pad 21 is mounted on the upper and inner sides of each fin 11.

Figure 2:
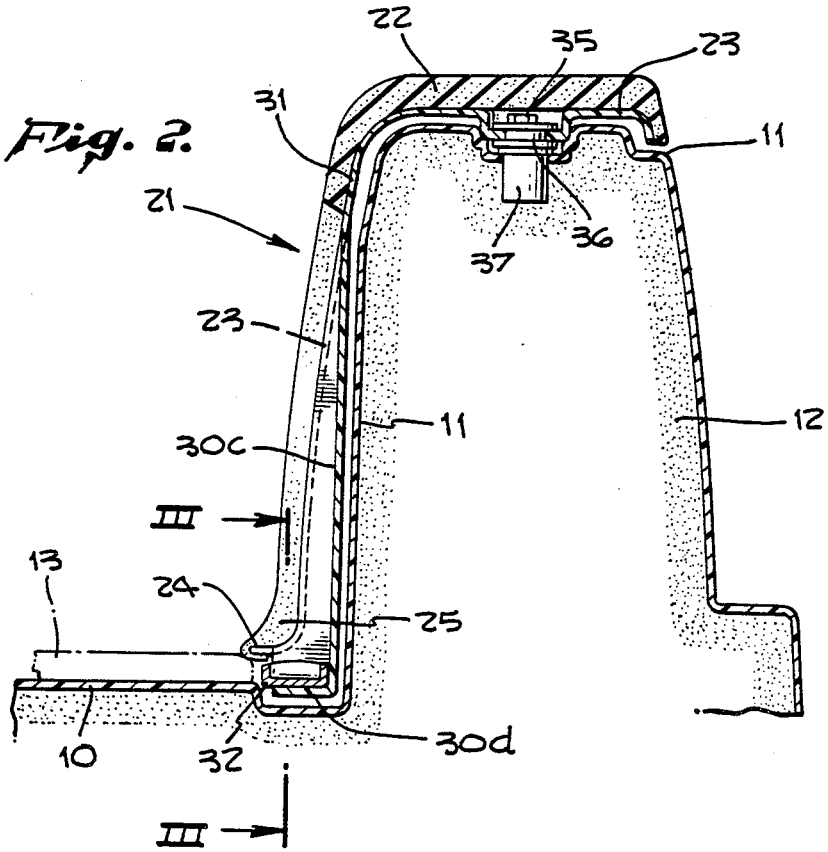
FIG. 2 is an enlarged fragmentary cross section taken along line 2—2 of FIG. 1, but with the fin pad 21 mounted.

As shown in FIG. 2, the fin pad 21 includes an outer cushion 22 of elastic foam rubber covering a back base sheet 23 of polypropylene or other resin. The cushion 22 and back sheet 23 are formed integrally. The floor 10 is covered by a mat 13.

The back sheet 23 extends substantially downwardly over the inner side of fin 11, but is spaced from it. This sheet 23 has an inner lower edge of floor mat 13. The cushion 22 has an inner lower edge portion 25 curing along the edge 24 of back sheet 23 and covering it.

Figure 3:
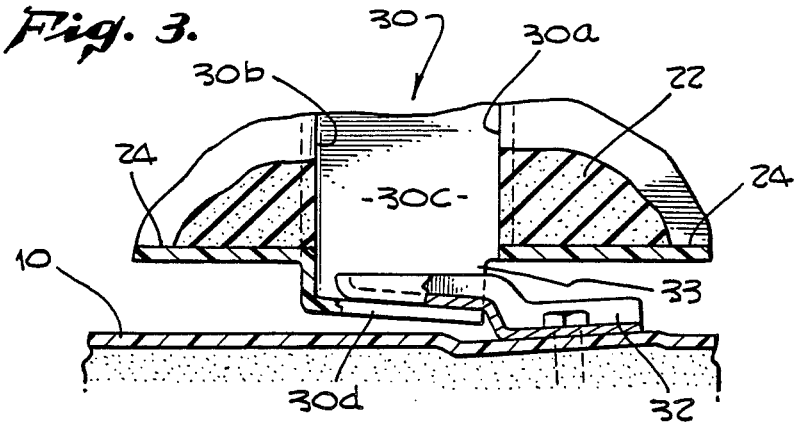
FIG. 3 is a fragmentary cross section taken along line 3—3 of FIG. 2.
Figure 4:
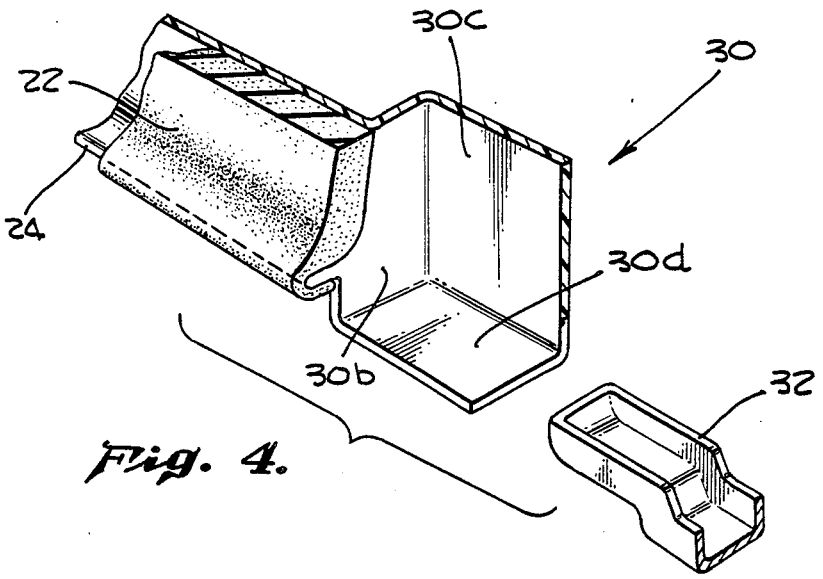
FIG. 4 is a fragmentary perspective view partially in cross section, in a different position, of parts shown in FIGS. 1-3.

The back sheet 23 is formed with anchor parts 30 FIG. 1) extending downwardly from adjacent its shoulder 31 (FIG. 2). As shown in FIGS. 2-4, each anchor part 30 has front and rear substantially triangular sides **30*a* and 30*b*, and an outer side 30*c* terminating in a horizontal lower side 30*d*. The outer side 30*c* is close to the fin 11. The cushion 22 is cut out at the anchor parts 30**.

As best shown in FIG. 3, these rear and outer sides **30*b* and 30*c* extend downwardly beyond the lower edge 24 of back sheet 23, but the front side 30*a* is shorter to form a bottom opening 33. A bracket 32 is bolted to the floor 10 for engagement into the opening 33 and with the lower side 30*d***.

As shown in FIG. 1, the fin pad 21 is placed onto the fin 11 and pushed forwardly so that the lower side **30*d* of the anchor engages the bracket 32**.

As shown in FIG. 2, the top side of back sheet 23 of fin pad 21 is provided with bolts 34, each adapted to engage through a collar 36 with a rubber nut 37 embedded in the top side of fin 11. This allows the fin pad 21 to be fixed to the fin 11, with the anchor 30 engaging with the bracket 32.

Thus, as shown in FIG. 2, the edges 24 and 25 of fin pad 21 curve inwardly and overlie on the adjacent edge of floor mat 13. When the rider steps on the mat edge, his weight is applied on both the pad 21 and mat 13, without producing a clearance between the pad and mat edges, as would be produced if only the mat 13 were flexed.

Figure 7:
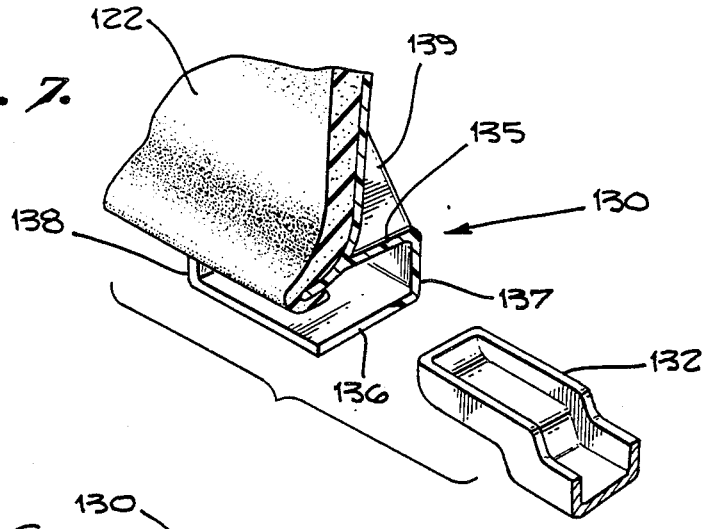
FIG. 7 is a view similar to FIG. 4, but showing the embodiment of FIGS. 5-6.
Figure 6:
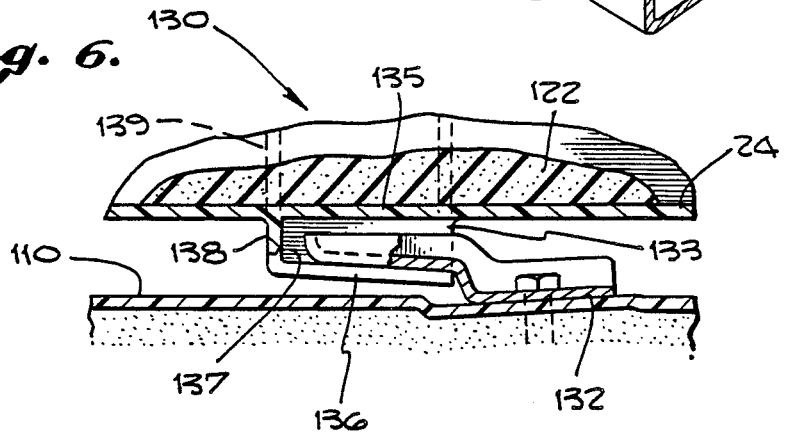
FIG. 6 is a fragmentary cross section taken along line 6—6 of FIG. 5.
Figure 5:
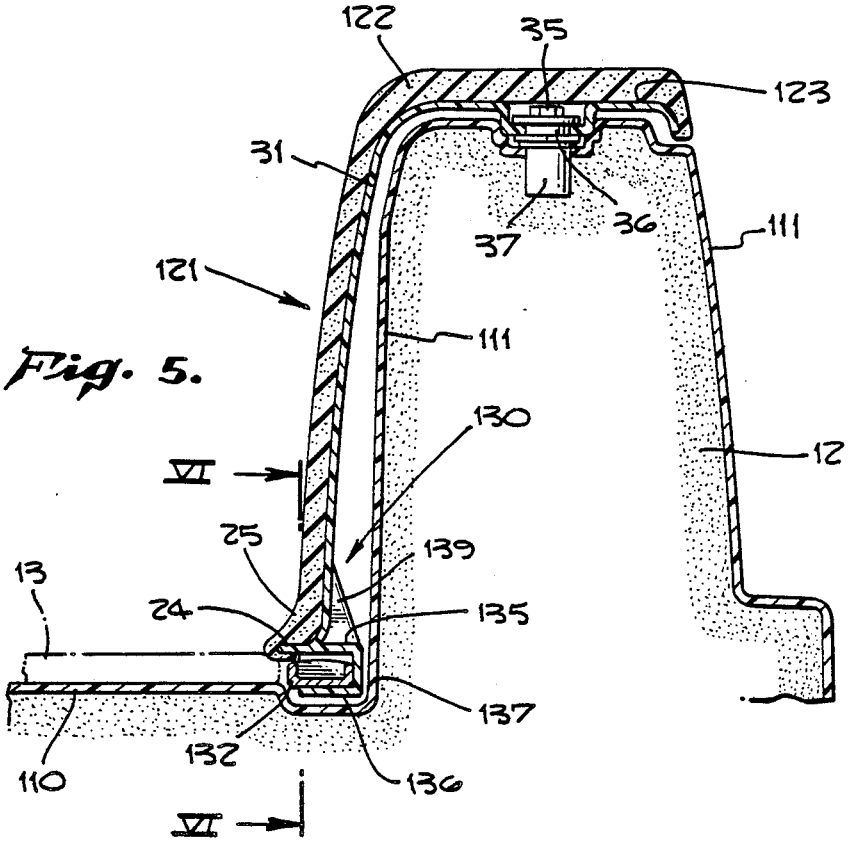
FIG. 5 is a view similar to FIG. 2, but showing a more preferred embodiment of the invention.
Figure 8:
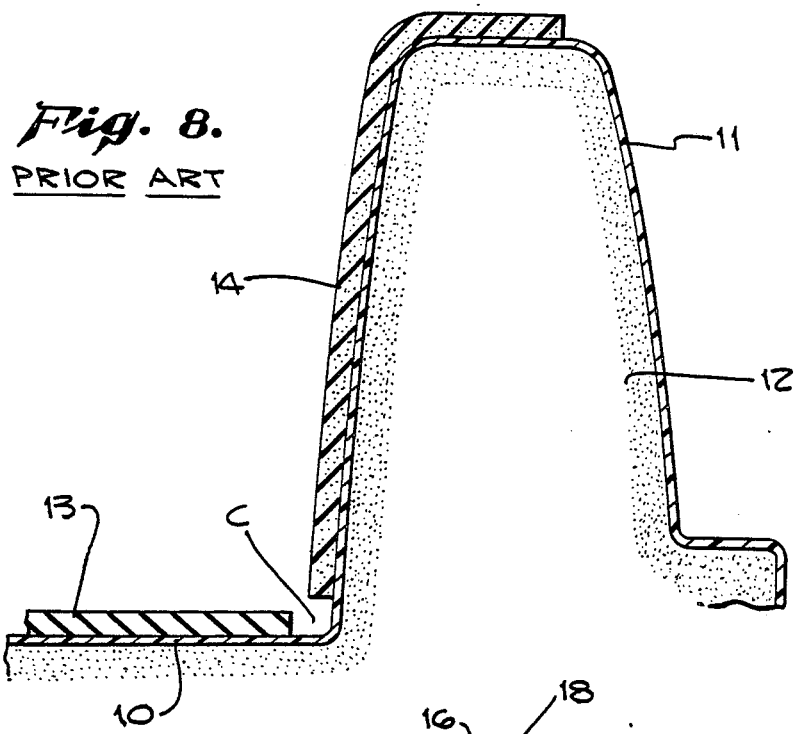
Fig. 8. PRIOR ART
FIGS. 8 and 9 are fragmentary cross sections respectively showing prior art fin pads.
Figure 9:
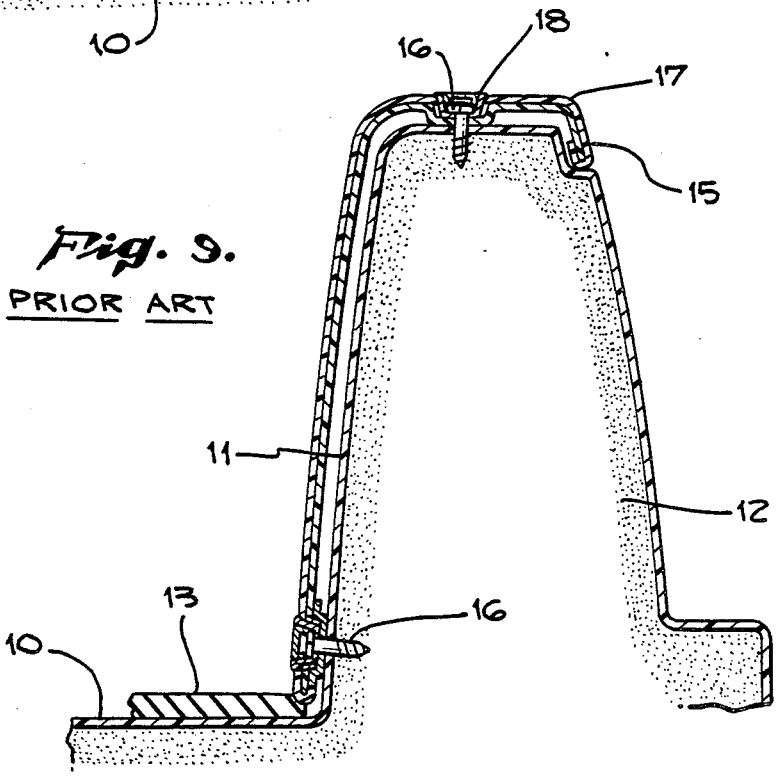
Fig. 9. PRIOR ART

FIGS. 5-7 show a more preferred embodiment, wherein a fin pad 121 includes a cushion 122 and a back sheet 123, which are basically the same as in the first embodiment. The pad 121 extends substantially downwardly over the inner side of fin 111, but is spaced from it. The pad 121 is provided with anchor parts 130 at its lower edge.

Each anchor part 130 has upper and lower horizontal sides 135 and 136, outer and rear vertical sides 137 and 138 bridging the horizontal sides, and a front opening 133 for engagement with a bracket 132 bolted to the floor 110. The anchor 130 can be enforced by triangular members 139 provided between the upper side 135 and back sheet 123.

What is claimed:

1. A fin pad for covering one of the upstanding fins positioned on both sides of a deck floor and center line of a small watercraft, said floor being covered by a mat between said fins, said pad comprising:

a cushion having an inner lower edge, which curves toward a mat and generally toward a centerline of a small watercraft and overlies an adjacent edge of said mat, a back sheet covered by said cushion and adapted to be fixed to at least one of a pair of fins of said watercraft, and anchor means provided on an inner lower edge of said back sheet to engage a part of said floor.

* * * * *